US008974241B2

(12) United States Patent
Finona et al.

(10) Patent No.: US 8,974,241 B2
(45) Date of Patent: Mar. 10, 2015

(54) BRACKET FOR CONNECTOR PIN SEALS

(71) Applicant: ITT Manufacturing Enterprises, LLC, Wilmington, DE (US)

(72) Inventors: Michael S. Finona, Lake Forest, CA (US); Le Huu Nguyen, Lakewood, CA (US)

(73) Assignee: ITT Manufacturing Enterprises, LLC, Wilmington, DE (US)

( * ) Notice: Subject to any disclaimer, the term of this patent is extended or adjusted under 35 U.S.C. 154(b) by 122 days.

(21) Appl. No.: 13/751,582

(22) Filed: Jan. 28, 2013

(65) Prior Publication Data

US 2014/0213086 A1 Jul. 31, 2014

(51) Int. Cl.
*H01R 13/52* (2006.01)

(52) U.S. Cl.
CPC ..... *H01R 13/5208* (2013.01)
USPC ..... 439/271; 439/586

(58) Field of Classification Search
CPC ..... H01R 13/5221; H01R 13/5219; H01R 13/5202; H01R 13/115; H01R 13/46
USPC ..... 439/271, 586, 587
See application file for complete search history.

(56) References Cited

U.S. PATENT DOCUMENTS

| | | | | |
|---|---|---|---|---|
| 3,573,720 | A | 4/1971 | Reynolds | |
| 3,747,047 | A | 7/1973 | Carter et al. | |
| 4,776,813 | A | 10/1988 | Wilson et al. | |
| 4,802,867 | A * | 2/1989 | Palmer | 439/587 |
| 4,921,437 | A | 5/1990 | Cooper et al. | |
| 4,950,175 | A | 8/1990 | Plyler et al. | |
| 4,963,103 | A | 10/1990 | Fink et al. | |
| 5,017,162 | A | 5/1991 | Krehbiel et al. | |
| 5,066,242 | A * | 11/1991 | Martucci | 439/281 |
| 5,098,315 | A | 3/1992 | Scowen | |
| 5,266,045 | A * | 11/1993 | Yamamoto et al. | 439/275 |
| 5,302,138 | A | 4/1994 | Shields | |
| 5,435,760 | A * | 7/1995 | Miklos | 439/321 |
| 5,490,785 | A | 2/1996 | Hein et al. | |
| 5,613,868 | A * | 3/1997 | Ohsumi et al. | 439/275 |
| 5,775,930 | A | 7/1998 | Model et al. | |
| 6,004,153 | A | 12/1999 | Myer et al. | |
| 6,095,860 | A * | 8/2000 | Gehrke et al. | 439/587 |
| 6,257,928 | B1 * | 7/2001 | Murakami et al. | 439/587 |
| 6,332,803 | B1 | 12/2001 | Matsuda et al. | |
| 6,383,022 | B1 * | 5/2002 | Murakami et al. | 439/589 |
| 6,514,098 | B2 | 2/2003 | Marpoe et al. | |

(Continued)

FOREIGN PATENT DOCUMENTS

| | | | |
|---|---|---|---|
| AU | 2010202134 | B | 1/2011 |
| CN | 201392933 | Y | 1/2010 |

(Continued)

*Primary Examiner* — Hae Moon Hyeon
(74) *Attorney, Agent, or Firm* — RatnerPrestia

(57) ABSTRACT

An electrical connector includes a housing having a bracket mating surface and an opening that extends through the bracket mating surface; an electrical conductor that is positioned through the opening in the housing; a grommet that is positioned in a space defined between the electrical conductor and the opening in which the conductor is positioned to substantially prevent contaminants from entering the housing through the opening; and a bracket removably positioned on the bracket mating surface of the housing of the connector and positioned to bear on the grommet to substantially prevent displacement of the grommet with respect to the housing of the connector.

10 Claims, 6 Drawing Sheets

(56) References Cited

U.S. PATENT DOCUMENTS

| | | | | |
|---|---|---|---|---|
| 6,672,900 | B2 * | 1/2004 | France et al. | 439/587 |
| 6,814,617 | B2 * | 11/2004 | Oota et al. | 439/589 |
| 7,101,192 | B1 | 9/2006 | Bordeau et al. | |
| 7,156,698 | B2 * | 1/2007 | Yamashita | 439/587 |
| 7,347,745 | B1 | 3/2008 | Raudenbush et al. | |
| 7,381,084 | B1 | 6/2008 | Horn et al. | |
| 7,637,764 | B2 * | 12/2009 | Yoneda et al. | 439/275 |
| 8,235,744 | B1 | 8/2012 | Liptak et al. | |
| 2002/0048991 | A1 * | 4/2002 | France et al. | 439/587 |
| 2012/0142207 | A1 | 6/2012 | Duval et al. | |

FOREIGN PATENT DOCUMENTS

| | | | |
|---|---|---|---|
| DE | 202005007775 | U1 | 7/2005 |
| EP | 0452061 | A | 10/1991 |
| EP | 0804821 | B | 11/1997 |
| EP | 0848456 | B | 6/1998 |
| EP | 0967686 | B | 12/1999 |
| WO | WO96/38887 | | 12/1996 |

* cited by examiner

BRACKET FOR CONNECTOR PIN SEALS

FIELD OF THE INVENTION

The present invention is directed to an electrical contact assembly including a removable bracket for retaining one or more grommets, through which cable conductors of the electrical contact assembly are positioned.

BACKGROUND OF THE INVENTION

There exist electrical contact assemblies that include a connector housing having one or more openings, one or more cable conductors that are each positioned within a respective opening in the housing, and one or more rubber grommets that are each positioned around a respective cable conductor to seal the cable conductor in its respective opening. The rubber grommets substantially prevent contaminants from entering the interior of the housing through the one or more openings. In use, the cable conductors can be tugged, pushed or pulled, which can detach the rubber grommets from their respective openings, thereby allowing contaminants to enter the interior of the housing. The contaminants could degrade the performance of the electrical contact assembly. In view of the foregoing, it would be advantageous to either limit or prevent movement of the rubber grommets in an effort to prevent contaminants from entering the interior of the housing of the electrical contact assembly, while allowing intentional detachment of those grommets , for rework of the electrical contact assembly.

SUMMARY OF THE INVENTION

According to one aspect of the invention, an electrical connector includes a housing having a bracket mating surface and an opening that extends through the bracket mating surface; an electrical conductor that is positioned through the opening in the housing; a grommet that is positioned in a space defined between the electrical conductor and the opening in which the conductor is positioned to substantially prevent contaminants from entering the housing through the opening; and a bracket removably positioned on the bracket mating surface of the housing of the connector and positioned to bear on the grommet to substantially prevent displacement of the grommet with respect to the housing of the connector.

According to another aspect of the invention, an electrical connector includes a housing having a bracket mating surface and a plurality of openings that extend through the bracket mating surface; a plurality of conductors, each of which is positioned in a respective opening in the housing; a plurality of grommets, each of which is positioned in a space defined between a respective conductor and an opening in which the respective conductor is positioned to substantially prevent contaminants from entering the housing through the opening; and a bracket removably positioned on the bracket mating surface of the housing of the connector and positioned to bear on at least one of the grommets to substantially prevent displacement of the at least one grommet with respect to the housing of the connector.

BRIEF DESCRIPTION OF THE DRAWINGS

The invention is best understood from the following detailed description when read in connection with the accompanying drawings, with like elements having the same reference numerals. Included in the drawings are the following figures.

DETAILED DESCRIPTION OF THE INVENTION

Figure 1:
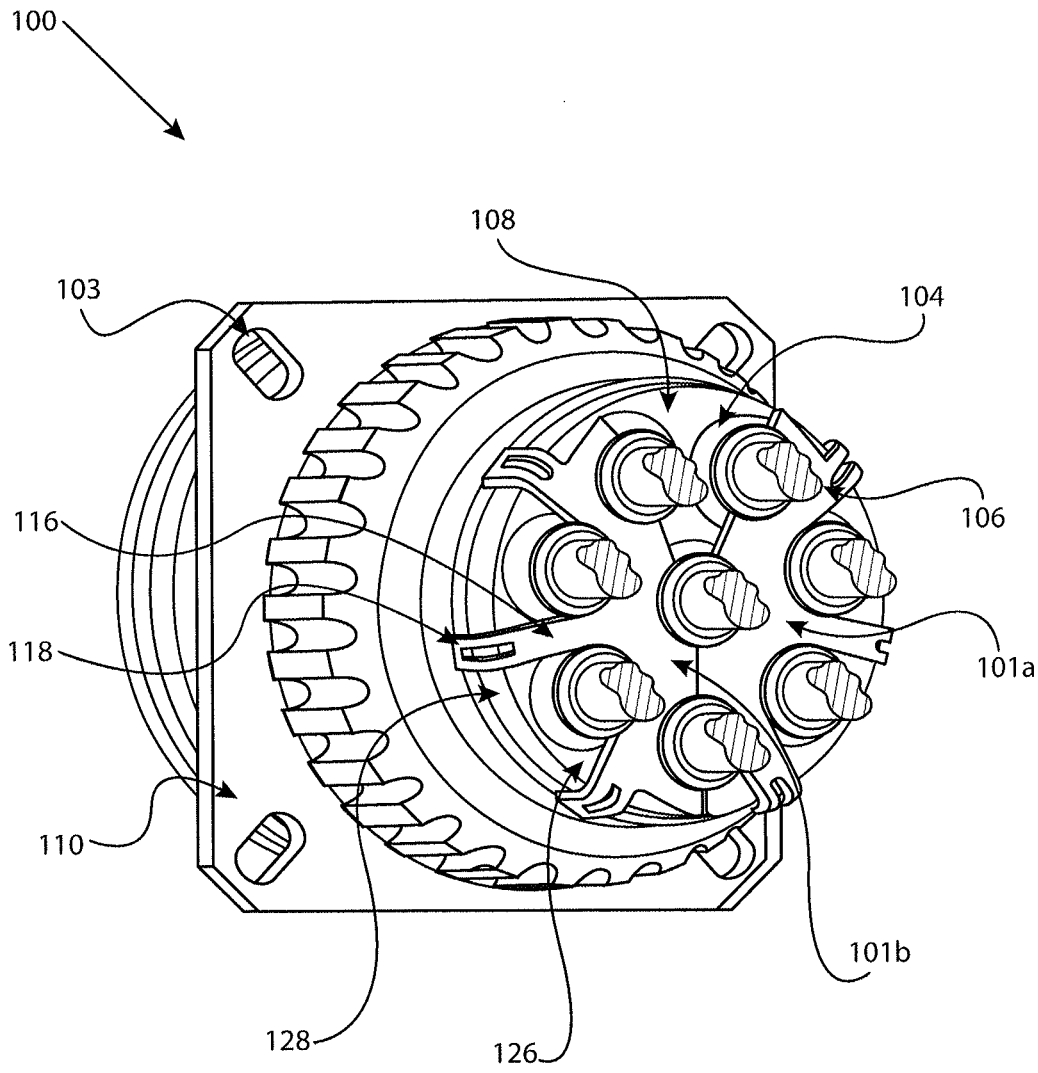
FIG. 1 depicts a perspective view of an electrical contact assembly having eight conductors and two brackets according to a first exemplary embodiment of the present invention.
Figure 2:
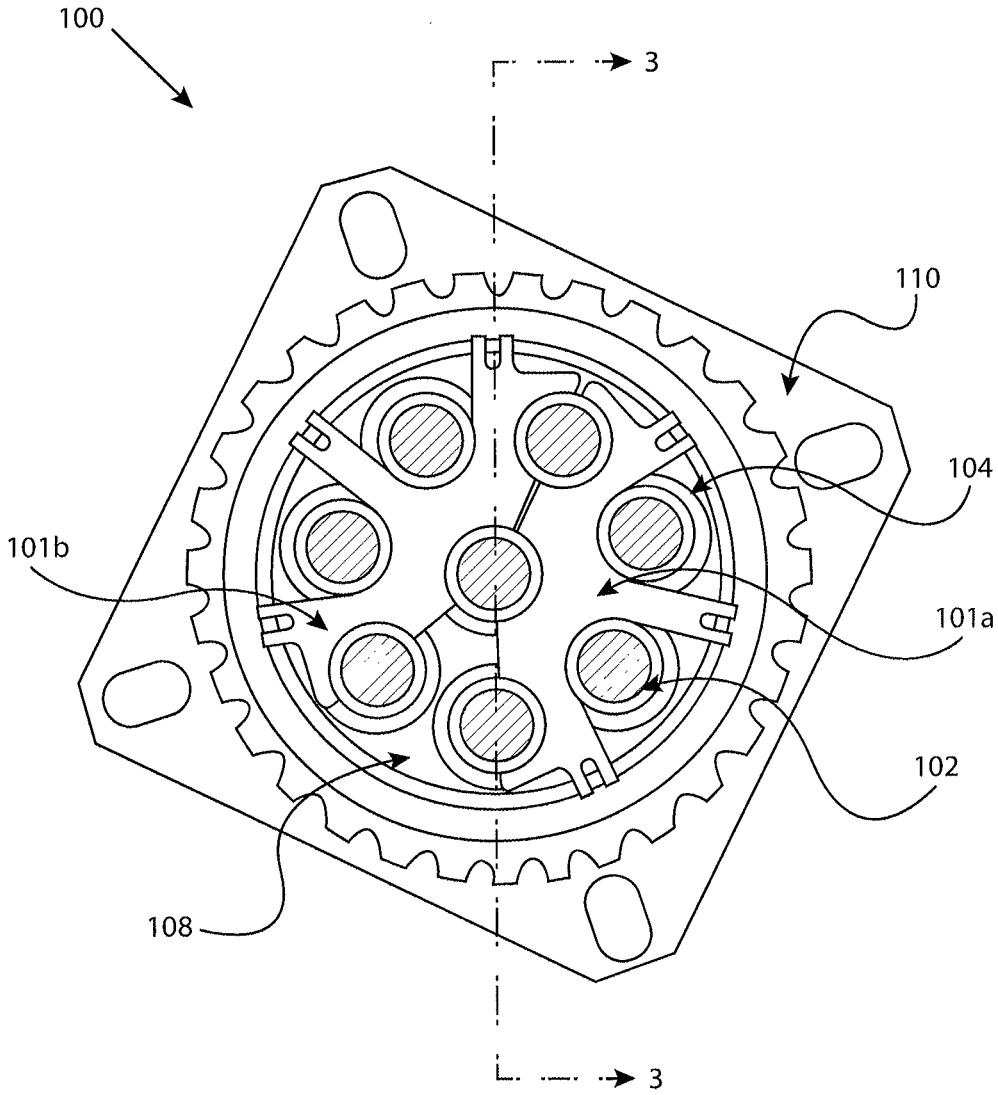
FIG. 2 is a front elevation view of the electrical contact assembly of FIG. 1.
Figure 3:
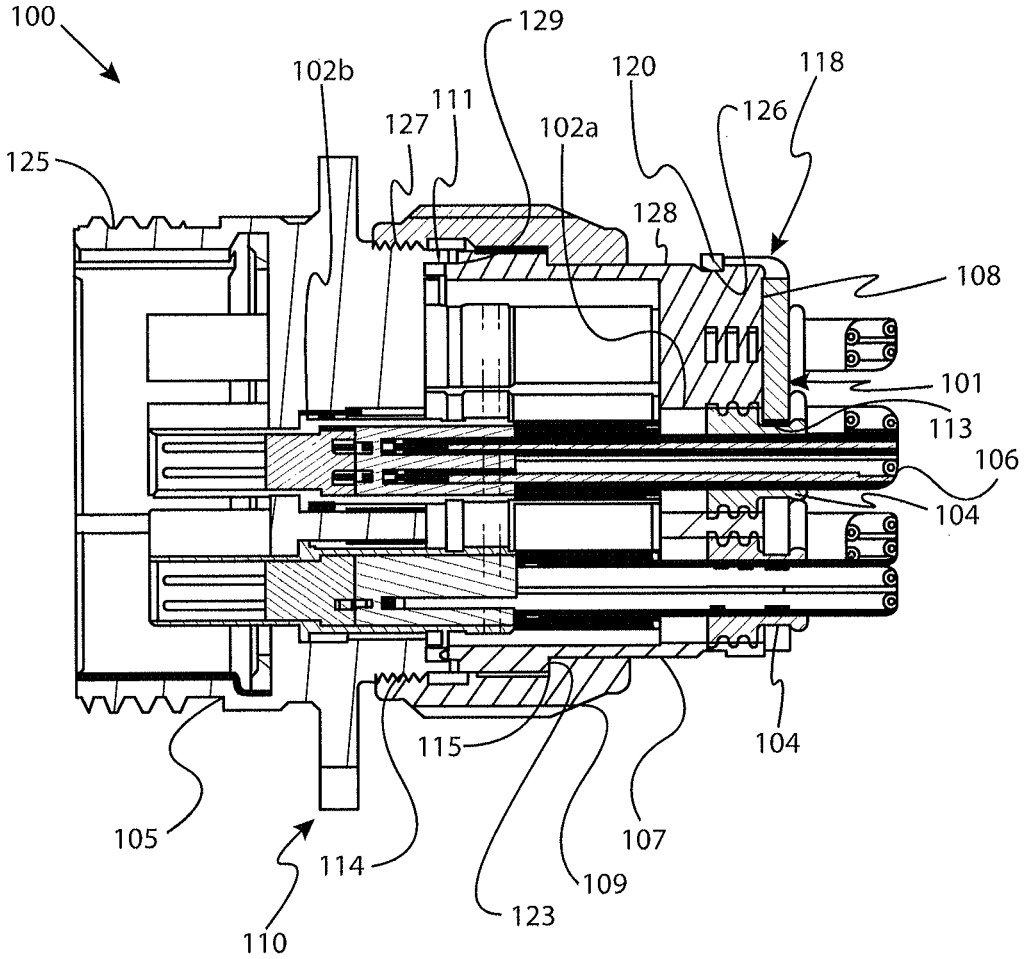
FIG. 3 is a cross sectional side elevation view of the electrical contact assembly of FIG. 2 taken along the lines 3-3.

Referring to FIGS. 1-3, in accordance with a first exemplary embodiment of the present invention, an electrical contact assembly 100 is illustrated. Electrical contact assembly 100 may be used to electrically transmit electrical signals. The electrical signals of the embodiment may travel from one location to another location through electrical contact assembly 100. The electrical contact assembly 100 may be a useful interface for electrically transmitting and distributing power and/or signals to another electrical component that is disposed external to the electrical contact assembly 100.

Referring generally to the overall assembly 100, the electrical contact assembly 100 generally includes a housing 110 in which a plurality of openings 102 (see FIG. 3) are defined (8 shown). A plurality of cable conductors 106 (8 shown) are positioned through the respective openings 102. Grommets 104 (8 shown) are each positioned in a respective opening 102 and around a respective cable conductor 106. Two brackets 101*a* and 101*b* (referred to collectively as brackets 101) are mounted to the housing 110 for maintaining the plurality of grommets 104 substantially fixed in their respective positions. The brackets 101 are releasably mounted to the housing 110 so as to enable field repair or replacement of the conductors 106.

It should be understood that the number of openings 102, grommets 104, conductors 106 and brackets 101 may vary from that which is shown and described. For example, the electrical contact assembly 100 may include a single opening 102, one conductor 106 positioned though that opening 102, one grommet 104 positioned in the opening 102 and over the single conductor 106 and one bracket 101 that is releasably mounted to the housing 110 for maintaining the single grommet 104 substantially fixed in position.

Referring now to the individual components of the electrical contact assembly 100, each cable conductor 106 is configured to transmit electricity from one location to another. Each cable conductor 106 may comprise one or more wires, pins, cables, windings, or sleeves. A cable conductor 106 may be made of any material used to conduct electricity.

As best shown in FIG. 3, the housing 110 is an assembly that is comprised of a first housing part 105, a second housing part 107, and a threaded ring 109 that releasably couples the housing parts 105 and 107 together. The individual components of the housing 110 may be composed of a metallic material, a polymeric material, or any other suitable material.

The first housing part 105 of the housing 110 has a substantially cylindrical body that includes a plurality of circular openings 102*b* . The distal end of the first housing part 105 includes mechanical threads 125 for connecting to a mating connector (not shown). A flange is disposed at the central region of the first housing part 105, and holes 103 are formed in that flange for attaching the electrical contact assembly 100 to another structure that is not shown. A circumferential projection 111 extends from the proximal end of the first housing part 105 to engage a shoulder 129 that is formed on the distal end of the second housing part 107. Mechanical threads 127 are provided on the proximal end of the first housing part 105, at a location that is distal of the projection 111, for engagement with mating threads on the threaded ring 109.

The second housing part 107 of the housing 110 has a substantially cylindrical body that includes a plurality of circular openings 102*a* (2 shown). The openings 102*a* terminate at a planar bracket mounting surface 108 that is defined on the proximal end of the second housing part 107. The openings 102*a* are defined through the bracket mating surface 108. A circumferential recess 126 is defined on a side surface 128 of the second housing part 107. A circumferential shoulder 129 is formed on the distal end of the second housing part 107 for engagement with the circumferential projection 111 of the first housing part 105. An annular shoulder 123 is defined in a central region of the exterior surface of the second housing part 107 for abutting against the threaded ring 109.

The threaded ring 109 of the housing 110 has a substantially cylindrical body. Mechanical threads 114 are provided on the distal end of the interior surface of the threaded ring 109 for engaging with mechanical threads 127 on the proximal end of the first housing part 105. A shoulder 115 is defined on the proximal end of the interior surface of the threaded ring 109 for abutment with the shoulder 123 that is formed on the second housing part 107. In assembly, rotating the threaded ring 109 onto the exterior threads 127 on the first housing part 105 causes the shoulder 115 of the threaded ring 109 to bear on the shoulder 123 of the second housing part 107 thereby mating the housing part 105 and 107 together. The threaded ring 109 of the housing 110 may also be referred to herein as a connector.

In assembled form, openings 102*b* and 102*a* of the housing parts 105 and 107, respectively, register with each other such that a cable conductor 106 is at least partially positioned through the registered openings 102*a* and 102*b*. Registered openings 102*a* and 102*b* are referred to collectively as openings 102.

The housing 110 of the electrical contact assembly 100 may vary from that which is shown and described. For example, the housing 110 may be a unitary component.

Eight grommets 104 are assembled into respective openings 102 on the proximal end of the housing 110. Each grommet 104 substantially prevents contaminants from entering the housing through the opening 102 in which the grommet 104 is positioned. Each grommet 104 includes a thru-hole that is sized to receive a single cable conductor 106. Each cable conductor 106 passes through a respective grommet 104. At least a portion of the revolved exterior surface of each grommet 104 makes sealing contact with the surface of a respective opening 102 in which a particular grommet 104 is positioned. The revolved interior surface of each grommet 104 makes sealing contact with the outer surface of a respective cable conductor 106. Thus, each grommet 104 creates a fluid-tight seal between a respective cable conductor 106 and the opening 102 in which that particular cable conductor 106 is positioned. Each grommet 104 includes a circumferential recess 113 that is formed on the outer surface. The recess 113 is delimited by two opposing shoulders. One or more brackets 101 are positioned in the recess 113. The grommets 104 may be composed of a rubber material, for example, or any other elastomeric material, that creates a seal between the cable conductors 106 and the housing 110. A grommet 104 may also be referred to herein as a seal or a sealing member.

Referring still to FIGS. 1-3, in an assembled form of the contact assembly 100, the grommets 104 protrude from the bracket mounting surface 108 at the proximal end of the housing 110 such that the grommets 104 extend outside of the housing 110. The portion of each grommet 104 that extends beyond the bracket mounting surface 108 is contacted by one or more brackets 101 that are mounted to the proximal end of the housing 110.

Figure 4A:
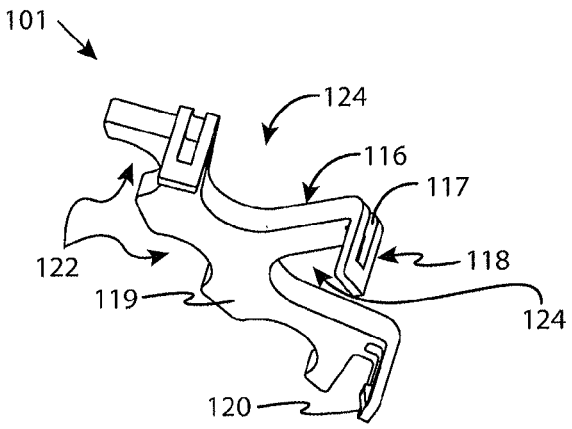
FIGS. 4A-4C depict perspective views of a bracket of the electrical contact assembly of FIG. 1.
Figure 4B:
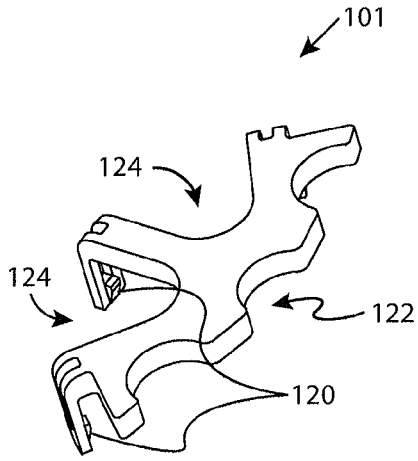
Figure 4C:
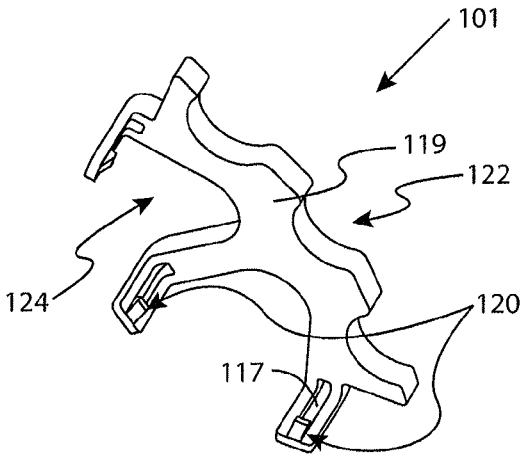

FIGS. 4A-4C depict perspective views of the bracket 101 of the contact assembly 100. The bracket 101 generally includes a flat body portion 116 having a uniform thickness, and a plurality of legs 118 (three shown) depending from the flat body portion 116 that extend substantially perpendicular to the flat body portion 116.

A series of radiused cutouts 122 (3 shown) are defined on one side of the flat body portion 116, while another series of radiused cutouts 124 (2 shown) are defined on the other side of the body portion 116. The radiused cutouts 124 are defined between adjacent legs 118. The cutouts 122 and 124 are sized to be sealingly positioned within the recesses 113 (see FIG. 3) on the exterior surface of the grommets 104.

A slot 117 is formed through each leg 118. Material at the end of each slot 117 is bent outwards to form a detent 120. The detents 120 are defined at the terminal end of the interior facing surface of each leg 118 at a location beneath the slots 117. The detent 120 is sized to be removably positioned within the recess 126 that is defined on the side surface 128 of the housing 110.

Referring back to FIG. 3, in an assembled form of the contact assembly 100, two brackets 101*a* and 101*b* (referred to collectively as brackets 101) are mounted on the proximal end of the housing 110. The underside 119 of the body portion 116 of each bracket 101 is positioned directly against the bracket mating surface 108. At least a portion of the surfaces defined by the cutouts 122 and 124 are positioned in respective recesses 113 that are formed on the outer surface of each grommet 104. The detents 120 of the legs 118 of the brackets 101 are then seated in the recess 126 that is defined on the side surface 128 of the housing 110. Engagement between the brackets 101, the housing 110 and the grommets 104 substantially prevents the grommets 104 from movement with respect to the housing 110.

Figure 5:
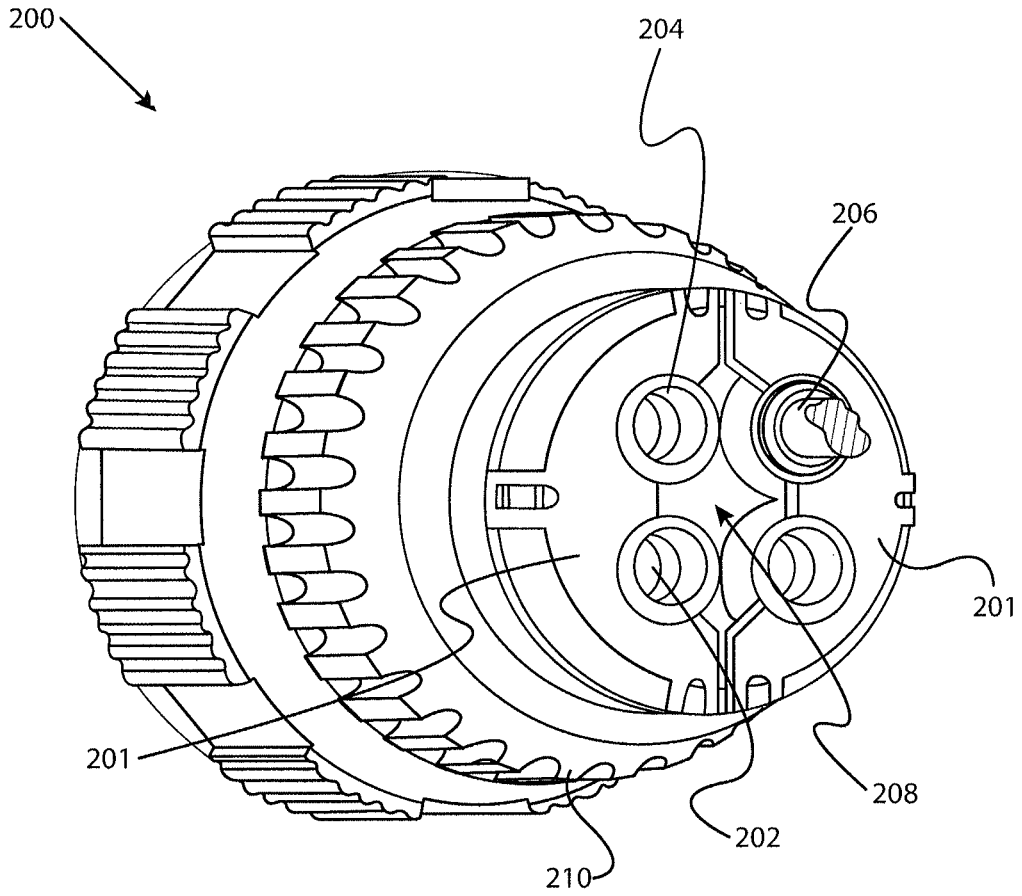
FIG. 5 depicts a perspective view of an electrical contact assembly having four conductors (one shown) and two brackets, according to a second exemplary embodiment of the invention.

FIG. 5 is a perspective view of an electrical contact assembly 200 having four conductors and two brackets, according to a second exemplary embodiment of the invention. The electrical contact assembly 200 is substantially similar to the electrical contact assembly 100 and only the differences between those electrical contact assemblies will be described hereinafter.

The electrical contact assembly 200 generally includes a housing 210 having a bracket mating surface 208 through which four openings 202 are defined, four cable conductors 206 (only one shown) positioned through the respective openings 202, four grommets 204 that are each positioned in a respective opening 202 and around a respective cable conductor 206, and two brackets 201 that are releasably mounted to the housing 210 for maintaining the grommets 204 substantially fixed in their respective positions.

Figure 6A:
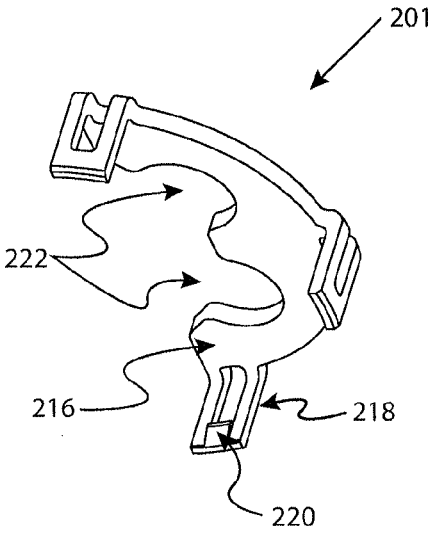
FIGS. 6A-6C depict perspective views of the bracket of the electrical contact assembly of FIG. 5.
Figure 6B:
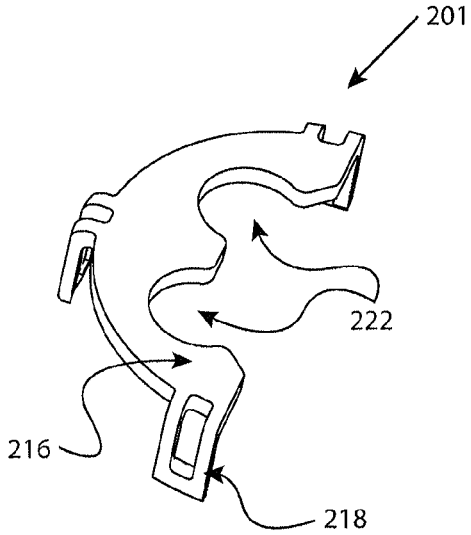
Figure 6C:
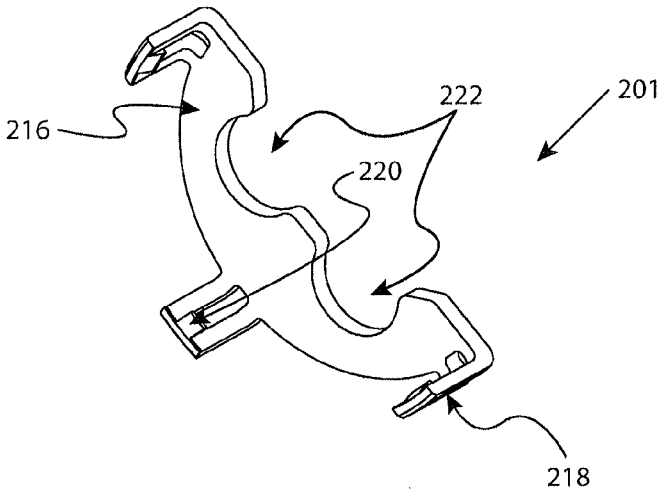

FIGS. 6A-6C depict the bracket 201 of the electrical contact assembly 200. Like the bracket 101 of FIGS. 4A-4C, the bracket 201 generally includes a flat body portion 216 having a uniform thickness, and a plurality of legs 218 (three shown) depending from the flat body portion 216 that extend substantially perpendicular to the flat body portion 216. Each leg 218 includes a detent 220, the purpose of which was described with reference to FIG. 3. Two cutouts 222 are defined on the interior-facing surface of the bracket 201. At least a portion of the edge of each cutout 222 is received in a recess that is formed in the grommets 204.

While preferred embodiments of the invention have been described herein, it will be understood that such embodiments are provided by way of example only. Numerous variations, changes and substitutions will occur to those skilled in the art without departing from the spirit of the invention. It is intended that the appended claims cover all such variations as fall within the spirit and scope of the invention.

What is claimed:

1. An electrical connector comprising:

a cylindrical housing having a bracket mating surface and a plurality of openings that extend through the bracket mating surface and are radially offset from one other about a longitudinal axis of the housing;

a plurality of conductors, each of which is positioned in a respective opening in the cylindrical housing;

a plurality of grommets, each of which is positioned in a space defined between a respective conductor and an opening in which the respective conductor is positioned to substantially prevent contaminants from entering the cylindrical housing through the opening, wherein an exterior surface of each grommet includes a recess; and a bracket removably positioned on the bracket mating surface of the housing of the connector and positioned to bear on at least one of the grommets to substantially prevent displacement of the at least one grommet with respect to the cylindrical housing of the connector, wherein the bracket includes a plurality of radiused surfaces that are each positioned in the recess of a respective grommet, and wherein the radiused surface are radially offset one other about the longitudinal axis of the housing.

2. The electrical connector of claim 1, wherein the bracket includes a detent for removably connecting the bracket to a surface of the housing.

3. The electrical connector of claim 1, further comprising a plurality of brackets, each of which is removably positioned on the bracket mating surface of the housing of the connector and is positioned to bear on at least one of the grommets.

4. The electrical connector of claim 1, wherein the bracket comprises an interior- facing cutout and an exterior-facing cutout.

5. The electrical connector of claim 1, wherein each grommet protrudes outside of the housing such that the bracket is positioned to bear on the protruding portion of the grommets.

6. The electrical connector of claim 1, wherein at least one of the plurality of grommets is contacted by two brackets that are removably positioned on the bracket mating surface of the housing.

7. The electrical connector of claim 1, wherein the housing comprises two housing parts that are releasably mounted together by a connector.

8. The electrical connector of claim 7, wherein the openings are defined in both housing parts of the housing, and respective openings of both housing parts are configured to register with one other.

9. The electrical connector of claim 7, wherein the connector is a threaded ring.

10. The electrical connector of claim 1, wherein the bracket contacts at least one, but not all, of the grommets.

* * * * *